US008581478B2

(12) United States Patent
Bertram et al.

(10) Patent No.: US 8,581,478 B2
(45) Date of Patent: Nov. 12, 2013

(54) COOLING MEMBER FOR SEMICONDUCTOR LIGHT EMITTING ELEMENTS

(75) Inventors: Ralph Bertram, Nittendorf (DE); Nicole Breidenassel, Bad Abbach (DE); Klaus Burkard, Regensburg (DE); Florian Zeus, Zeitlarn (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/377,835

(22) PCT Filed: May 26, 2010

(86) PCT No.: PCT/EP2010/057254

§ 371 (c)(1),
(2), (4) Date: Dec. 13, 2011

(87) PCT Pub. No.: WO2010/145926

PCT Pub. Date: Dec. 23, 2010

(65) Prior Publication Data

US 2012/0086320 A1 Apr. 12, 2012

(30) Foreign Application Priority Data

Jun. 15, 2009 (DE) ..... 10 2009 024 904

(51) Int. Cl.
*H01J 1/02* (2006.01)
*H01J 7/24* (2006.01)

(52) U.S. Cl.
USPC ..... 313/11; 313/567; 313/13

(58) Field of Classification Search
None
See application file for complete search history.

(56) References Cited

U.S. PATENT DOCUMENTS

| | | | | |
|---|---|---|---|---|
| 7,758,223 | B2 * | 7/2010 | Osawa et al. | 362/547 |
| 2008/0007953 | A1 | 1/2008 | Keller et al. | |
| 2008/0175003 | A1 | 7/2008 | Tsou et al. | |

FOREIGN PATENT DOCUMENTS

| | | | |
|---|---|---|---|
| CN | 1880844 | A | 12/2006 |
| DE | 202007008258 | U1 | 10/2007 |
| DE | 202008006321 | U1 | 9/2008 |
| EP | 1503139 | A2 | 2/2005 |
| EP | 1047903 | B1 | 6/2007 |
| WO | 0017569 | A1 | 3/2000 |
| WO | 2009012806 | A1 | 1/2009 |

OTHER PUBLICATIONS

Machine translation of DE 202008006321 U1.
Machine translation of DE 202007008258 U1.
English abstract for CN 1880844 dated Dec. 20, 2006.

* cited by examiner

*Primary Examiner* — Natalie Walford

(57) ABSTRACT

A cooling member for at least one semiconductor light emitting element, in particular an LED, may include a mounting cavity for accommodating at least part of a control electronics unit, whereby the cooling member is composed of multiple cooling member parts, whereby each of which cooling member parts includes part of a wall of the mounting cavity.

19 Claims, 5 Drawing Sheets

COOLING MEMBER FOR SEMICONDUCTOR LIGHT EMITTING ELEMENTS

RELATED APPLICATIONS

The present application is a national stage entry according to 35 U.S.C. §371 of PCT application No. PCT/EP2010/057254 filed on May 26, 2010, which claims priority from German application No. 10 2009 024 904.4 filed on Jun. 15, 2009.

TECHNICAL FIELD

Various embodiments relate to a cooling member for at least one semiconductor light emitting element, in particular a light emitting diode (LED), and an LED lamp having such a cooling member.

BACKGROUND

"LED lamp" in the following is to be understood as a lighting appliance which with the aid of standard fittings (E12, E14, E26, E27, GU10 . . . ) can be used directly for example in order to replace incandescent lamps (also referred to as "retrofit"). The external shape and the appearance are for the most part modeled on incandescent lamps and meet the standards, for example with regard to the external dimensions.

Dissipation of the heat generated at the LEDs is absolutely essential for LED lamps. For the most part, passive cooling (without a fan) is called for, whereby passive cooling members are however comparatively bulky. With regard to so-called "retrofit" LED lamps which emulate conventional lamps, in particular incandescent lamps, and can be inserted in the standard fittings (E12, E14, E26, E27, GU10 etc.) thereof, the passive cooling members should moreover emulate the external shape of incandescent lamps. From this results a rotational symmetry which has hitherto been designed using one-piece cooling members, for the most part made of aluminum or an aluminum alloy. The problem is that for reasons of space an electronic driver circuit needs to be incorporated into a mounting cavity in the interior of the cooling member for operation of the LED lamp or of the LED(s). The opening is typically open at the lower end (in the region of the lamp cap) and closed at the mounting surface of the LED(s) in order that the LED(s) can be connected to the cooling member without any air gaps as far as possible in order to avoid thermal bottlenecks. However, the shaping of this hollow space has hitherto been restricted to straight edges during manufacture of the cooling member; in particular it is not possible to emulate an incandescent lamp shape in the interior, which results in increased consumption of materials due to a solid construction. It has also hitherto been necessary to laboriously route cables from the electronic driver circuit to the LED(s) through small holes, which makes for a high manufacturing resource requirement.

EP 1 047 903 B1 discloses an LED lamp having a column, a lamp cap which is connected to an end of the column, and a substrate which is connected to the other end of the column and which is provided with a number of LEDs, whereby the substrate has a regular polyhedron having at least four faces, whereby faces of the polyhedron are provided with at least one LED which, during operation of the lamp, has a luminous flux of at least 5 lm, and whereby the column is provided with heat-dissipating means which interconnect the substrate and the lamp cap.

EP 1 503 139 A2 discloses a compact LED light source which provides LED positioning along with thermal dissipation. The LED light source can be made with a heat-conductive plate which supports a plurality of LEDs mounted on the plate and in thermal contact with the plate. The plate further supports electrical circuitry which provides an electrical connection to the LEDs. A heat-conductive stem mechanically supports the plate and may provide a thermal conduction path from the plate away from the LEDs. A high concentration of LEDs can then be conveniently mounted and held in close proximity for increased optical system intensity, while providing a thermal exit path for the associated increase in heat concentration.

SUMMARY

Various embodiments provide a flexible means which is particularly simple to manufacture for cooling a control electronics unit for a lamp, in particular a retrofit lamp, operating with semiconductor lighting elements, in particular LEDs.

The cooling member is designed for cooling at least one semiconductor lighting element and has a mounting cavity for accommodating at least part of a control electronics unit. The cooling member is composed of multiple cooling member parts, whereby each of which cooling member parts includes part of a wall of the mounting cavity. The mounting cavity is therefore shared among the cooling member parts. Said cooling member has the advantage among other things that the control electronics unit does not need to be pushed into the mounting cavity but can be inserted, which means that greater ease of mounting is achieved. A very much more flexible design both of the mounting cavity and also of the control electronics unit is also achieved. There is no longer any restriction due to a cavity having straight edges. Furthermore, the cooling member parts can be produced more simply, in particular using an injection molding process.

The mounting cavity can be designed such that the consumption of materials and thus also the weight are kept to a minimum. In particular, the mounting cavity can also exhibit an incandescent bulb shape as its basic shape. In particular, a wall thickness of a cooling member core (cooling member without externally situated cooling fins) can be configured as essentially or exactly constant. Alternatively, the wall thickness can be designed such that it does not fall below a minimum thickness. In order to optimize the relationship between weight and heat conduction, the wall thickness can decrease as the distance from the LED increases.

The at least one semiconductor light emitting element can have one light emitting diode or multiple light emitting diodes. As a result, comparatively inexpensive and reliable light sources can be made available. In particular, the at least one light emitting diode can have a high-power light emitting diode, for example having an output of 2 Watts. "Light emitting diode" is understood to be any LED unit which can be mounted on the cooling member, for example an LED chip, an encapsulated light emitting diode, an LED package (housing or substrate connected to one or more LED chips by means of bonding (wire bonding, flip chip bonding etc.)) or an LED module (housing or substrate connected to one or more LED chips or LED packages using conventional connection methods (soldering etc.)), namely with or without optical elements.

The control electronics unit, in particular for the at least one LED, can be designed as a driver or as a different control device, for example one based on voltage or power regulation.

In particular, each of the cooling member parts can exhibit essentially the same basic shape. Simple manufacturability and good application options for the control electronics unit are thereby achieved. Cooling member parts having essentially the same, in particular the same, basic shape, for example the shape of an incandescent lamp in sections, can differ in detail, which however does not basically allow their design shape to differ from one to another. One of the cooling member parts may thus have one more cooling fins or have a groove or a spine which the other cooling member part does not have etc.

The cooling member parts can in particular exhibit an identical shape. It is thereby possible to achieve particularly simple production and stockkeeping, which enables more favorable unit costs.

Although three or more cooling member parts are encompassed, the cooling member is however preferably composed of two cooling member parts because this thus results in particularly simple production and mounting.

A connection plane of two cooling member parts can preferably be situated parallel to or on an axis of symmetry of the cooling member. In particular, a connection plane of two cooling member parts is situated parallel to or on a longitudinal axis of the cooling member, by means of which a vertical connection plane results. In other words, the cooling member is then split up vertically into the cooling member parts along the longitudinal axis or parallel thereto.

To provide for particularly simple mounting of the control electronics unit, the cavity or at least one of the cooling member parts, in particular each of the cooling member parts, can have a fixing means for fixing the control electronics unit, for example a slot for fixing a circuit board of the control electronics unit by inserting it into the slot.

To provide for particularly effective heat transfer from the control electronics unit to the cooling member by means of short distances, the wall of the mounting cavity can have at least one recess for accommodating an electronic component part of the control electronics unit, in particular a transformer. In addition or alternatively, for the same purpose the wall can have projections directed into the mounting cavity.

To provide for particularly simple assembly, two (of two or more) cooling member parts to be joined together can have matching connection elements and connection counterelements, such as pairs consisting of plug-in element (for example a pin)/plug-in counter element (for example a blind hole) or latching element (for example a latching lug)/latching counterelement (for example a latching opening). Said connection (counter) elements can in particular be disposed in the region of the LEDs ("top").

The cooling member can have at least one cable feedthrough between the mounting cavity and a fastening surface separated therefrom by an upper top wall for fitting the at least one semiconductor lighting element, whereby the cable feedthrough is shared among the cooling member parts. This means that when the cooling member parts are assembled electrical connecting lines, for example cables, can be laid between the cooling member parts, which results in a simplified mounting process.

A fastening surface for fitting the at least one semiconductor lighting element can be shared among the cooling member parts in order to ensure good thermal conductivity between the at least one semiconductor light emitting element and the cooling member.

The lamp which in particular is embodied as an LED retrofit lamp is equipped with such a cooling member. At least part of at least one control electronics unit is accommodated in the mounting cavity.

The shape of the mounting cavity and the shape of the control electronics unit can be coordinated with one another, for example through the provision of recesses and/or projections in the mounting cavity, such that it is also possible to accommodate large electronic component parts without any problem, in particular a transformer.

The shape of the mounting cavity and the shape of the control electronics unit can in particular be matched to one another such that at least one wall region of the mounting cavity is formed plane-parallel with respect to a an opposite surface area of the electronic component. It is thus possible to achieve in particular a well defined, smallest possible distance between the plane-parallel faces for an effective heat transfer to the cooling member. It is thereby in turn also possible to provide a thermally effective connection to the cooling member for electronic component parts which heat up or are critical in respect of overheating such as the transformer and where applicable power transistors.

To provide for an optimum thermal connection and to exploit the available space, at least one wall region of the mounting cavity, which is formed plane-parallel with respect to an opposite surface area of the electronic component, can constitute a part of a projection or of a recess of the mounting cavity.

Between at least one electronic component of the control electronics unit and the cooling member there can be at least one "thermal interface material" (TIM), incorporated in particular in the form of a thermally conductive pad. It is thereby possible to achieve a particularly effective heat transfer from the electronic component (transformer, transistor, microprocessor etc.) onto the cooling member. In this situation, the divisibility of the cooling member makes it possible to incorporate the thermally conductive interface material is a particularly simple and versatile manner.

To provide for particularly effective cooling of the electronic components, at least one thermal interface material exhibits a thermal conductivity of at least 1 W/(m·K), preferably of greater than 3 W/(m·K) and by particular preference of greater than 5 W/(m·K).

To provide for effective cooling of the control electronics unit, the mounting cavity can be completely filled with at least one thermal interface material. Thus, in particular, a narrow space between plane-parallel faces of critical component parts and cooling member can be filled with a thermal interface material having a comparatively high thermal conductivity (for example of at least 5 W/(m·K)) and the remaining space of the mounting cavity can be filled with a thermal interface material having a comparatively low thermal conductivity (for example of less than 5 W/(m·K)). In particular, the thermal interface material having the comparatively high thermal conductivity (for example of at least 5 W/(m·K)) can be employed with an open cavity (cooling member parts not yet assembled), whereas the thermal interface material having the comparatively low thermal conductivity, which is flowable, can only be introduced into the opening of the cavity after assembly of the cooling member in order to completely fill the cavity. A "flowable material" is understood to be both a material which is flowable on its own and also a material which is flowable only under an external influence. Flowable materials include gels, foams and pastes among others.

To provide for simple mounting of the lamp, an insulating part, in particular made of plastic, where applicable however also a ceramic etc., can attach to an opening of the mounting cavity, whereby the insulating part is at least partially covered by a connector cap. In this situation, the cooling member parts are connected by means of the insulating part and/or the connector cap, for example by way of a plug-in or snap-in fitting. This means that when the cooling member is assembled it can firstly be at least partially assembled at the top in the region of the semiconductor component parts by means of the connection (counter) elements and then finally assembled and fixed at the bottom in the region of the opening of the mounting cavity.

A method for producing such a lamp can for example have at least the following steps:

- introduction of at least part of the control electronics unit into the cavity;
- at least partial filling of the cavity with at least one flowable thermal interface material;
- fixing at least one light emitting diode on the cooling member.

The step of introducing the control electronics unit into the cavity can include a step of introducing the control electronics unit into a cavity part of a cooling member part. As a result of the introduction into this 'exposed' cavity part, particularly simple production and a geometrically flexible configuration are made possible. Thus, for example, the control electronics unit does not need to be pushed into the cavity but can be inserted laterally through the open side.

The step for introducing the control electronics unit can be preceded by a step for applying a non-flowable (solid) thermal interface material, in particular a TIM pad, to at least one component part of the control electronics unit. The application is effected preferably on a region of the component part which is provided for positioning purposes with respect to a surface of the mounting cavity which is plane-parallel thereto, in other words is preferably intended for thermally bridging a narrow gap between the control electronics unit and the cooling member part. The application can be carried out for example by laying or sticking the solid TIM material on.

In a following step, the individual cooling member parts can be assembled to produce the complete cooling member.

The cavity of the complete assembled cooling member can be filled with at least one or a further thermal interface material, in particular a flowable TIM material.

In this manner it is possible to implement an improved air displacement when introducing the TIM material(s).

BRIEF DESCRIPTION OF THE DRAWINGS

In the drawings, like reference characters generally refer to the same parts throughout the different views. The drawings are not necessarily to scale, emphasis instead generally being placed upon illustrating the principles of the various embodiments. In the following description, various embodiments are described with reference to the following drawings, in which.

DETAILED DESCRIPTION

The following detailed description refers to the accompanying drawings that show, by way of illustration, specific details and embodiments.

Figure 1:
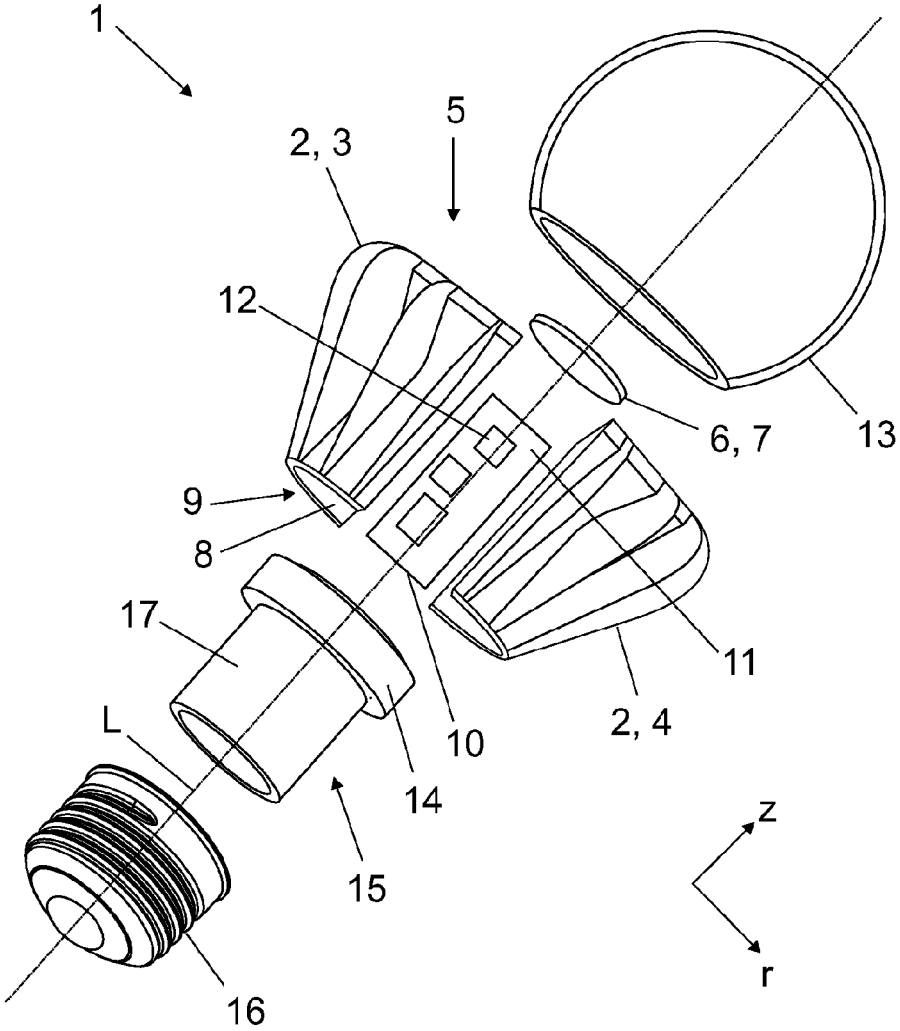
FIG. 1 shows an oblique exploded view of a structural design of an LED lamp having a cooling member which is composed of two cooling member parts.

FIG. 1 shows an oblique exploded view of a structural design of an LED lamp 1 having a cooling member 2. The cooling member 2 is composed of two identical cooling member parts 3,4 which exhibit a vertical connection plane, whereby the connection plane has a longitudinal axis L of the cooling member 2. In other words, the cooling member 2 is divided vertically into the two cooling member parts 3,4. On an upper side 5 (with respect to the z-axis) of the cooling member 2 is placed an LED module 6, of which an LED circuit board 7 is visible in this illustration. On the LED circuit board 7 are mounted one or more high-power light emitting diodes on the side facing away from the cooling member 2, namely in the form of white LED chips which are secured on a submount. The principal radiation axis of the light emitting diodes thus lies along the longitudinal axis L. The LED lamp 1 and in particular the cooling member 2 are essentially built angularly symmetrically around the longitudinal axis L. In a mounting cavity 8—shared among the cooling member parts 3,4—which is open on the underside 9 of the cooling member, is inserted a control electronics unit 10 which has a circuit board 11 and electronic component parts 12 mounted thereon such as a transformer, power transistors etc. With the cooling member 2 assembled, the control electronics unit 10 is accommodated completely in the mounting cavity 8.

The LED module 6 is covered by means of a translucent protective cover 13 which is mounted and secured on the upper side 5 in a corresponding guide receptacle of the cooling member 2. On the underside 9 of the cooling member 2, a wider section 14 of an insulating part 15 made of plastic is inserted into the mounting cavity 8. A lamp cap 16 for supplying power is fitted over a narrower section 17 of the insulating part 15. The lamp cap 16 is implemented as a standard fitting (for example E12, E14, E26, E27, GU10 etc.) which means that the LED lamp can be used directly for example in order to replace incandescent lamps (also referred to as "retrofit"). The external shape (for example having a rotational symmetry around the longitudinal axis) and the appearance are modeled on a conventional incandescent lamp and meet the requirements relating thereto. The LED lamp 1 can therefore readily be used as a replacement for a conventional incandescent lamp ("retrofit").

Figure 2:
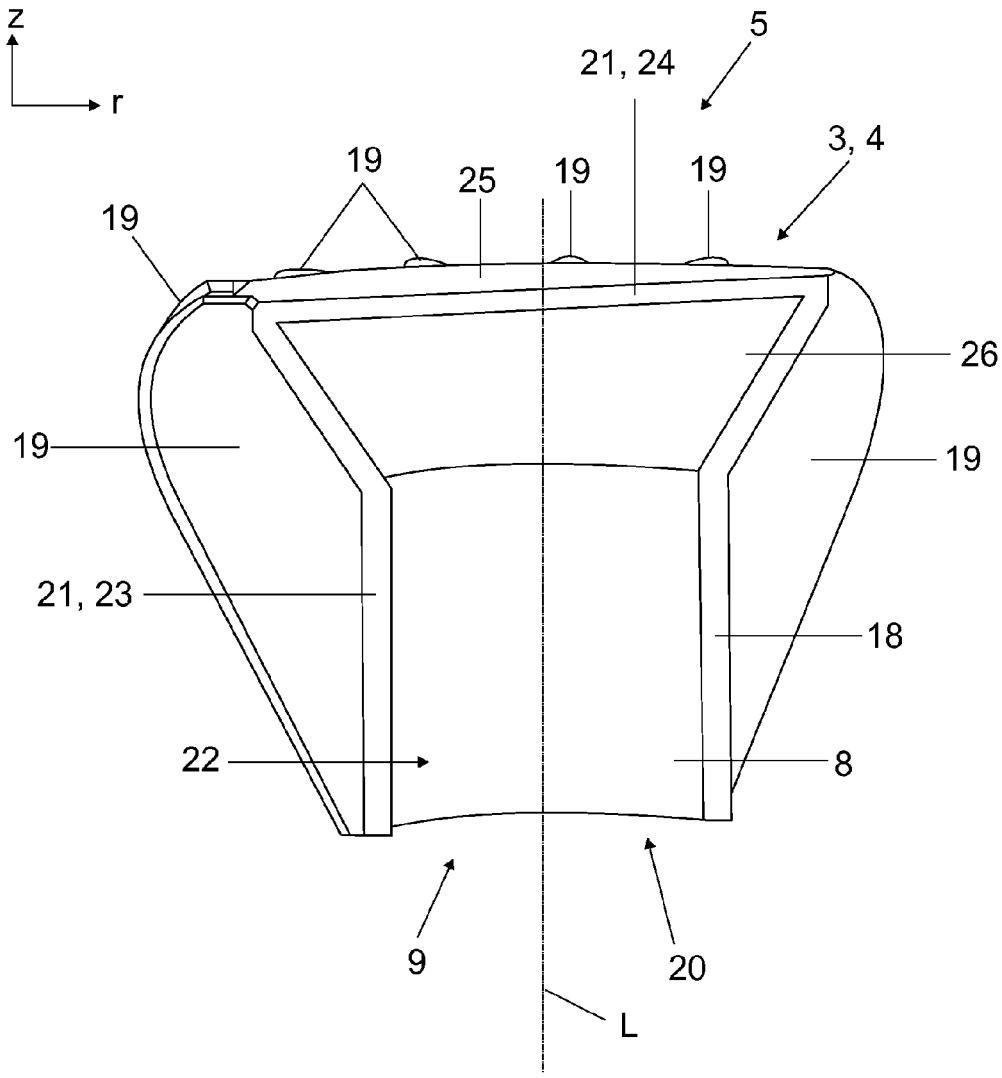
FIG. 2 shows an oblique view of a cooling member part of the cooling member from FIG. 1 according to a first embodiment.

FIG. 2 shows an oblique view of a cooling member part 3 or 4 according to a first embodiment, looking at its open side, which is to be joined together with the other respective cooling member part 4 or 3. The cooling member part 3,4 has a cooling member core 18, into which the cavity 8 is incorporated and which on its outer side has radially (in the r-axis) projecting and vertically (in the z-axis) oriented cooling fins 19. The cavity 8 and the cooling fins 19 are thus evenly distributed over the two cooling member parts 3,4. The cooling fins 19 are disposed angularly symmetrically around the longitudinal axis 19. The cavity 8 has an opening 20 on its underside 9. The cooling member core 18 is designed in the form of an aluminum wall 21 having a circumferential side wall 23 and an upper top wall 24, whereby an inner wall surface 22 delimits the cavity 8. The outer side of the top wall 24 serves as a fastening surface 25 for the face-to-face fitting of the LED module; for the purpose of effective heat transfer from the LED module onto the cooling member 6 the fastening surface 25 is thus likewise distributed over the two cooling member parts 3,4. At the upper region on the upper top wall 24 the cavity 8 exhibits a broadening 26 in order to achieve a small wall thickness. On account of the cooling member core 18 which is merely constructed in wall-like fashion and in consequence of the large mounting cavity 8 this cooling member part 3,4 is particularly lightweight and can provide a particularly large space offering a simple accommodation facility on a control electronics unit having a more complex configuration.

Figure 3:
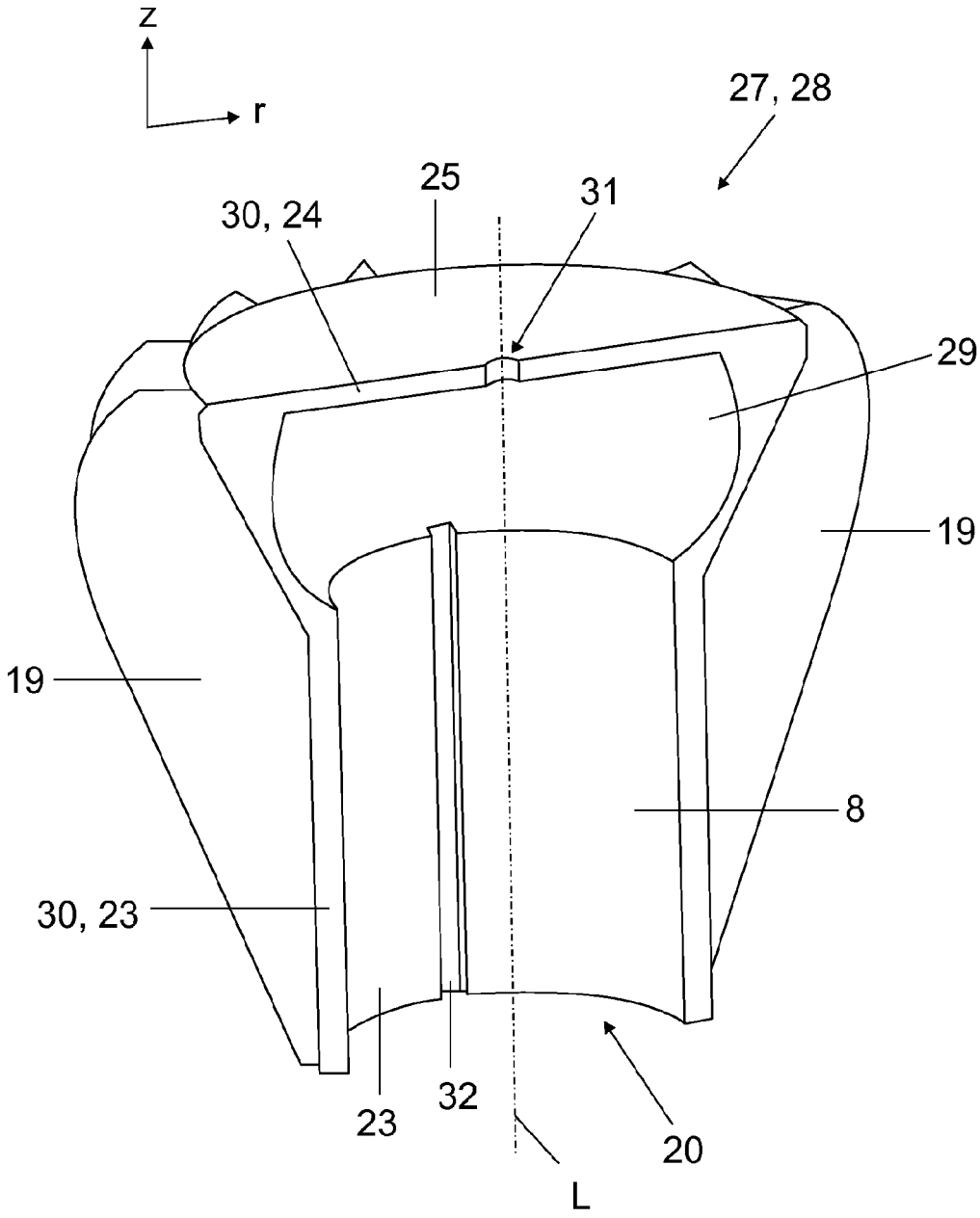
FIG. 3 shows an oblique view of a cooling member part of the cooling member from FIG. 1 according to a second embodiment.

FIG. 3 shows an oblique view of a cooling member part 27,28 according to a second embodiment. In this case, a contour of an upper bulging 29 is no longer rectilinear but exhibits outward curved sides to facilitate production. This means that the wall thickness of the cooling member core 30 is no longer uniform there. Not shown in FIG. 2 but included in the drawing here are one half of a cable feedthrough 31 for feeding an electrical connecting line through between the LED module and the control electronics unit and a slot 32 in a side wall 23 of the cavity 8 for fixing the circuit board of the control electronics unit.

Figure 4:
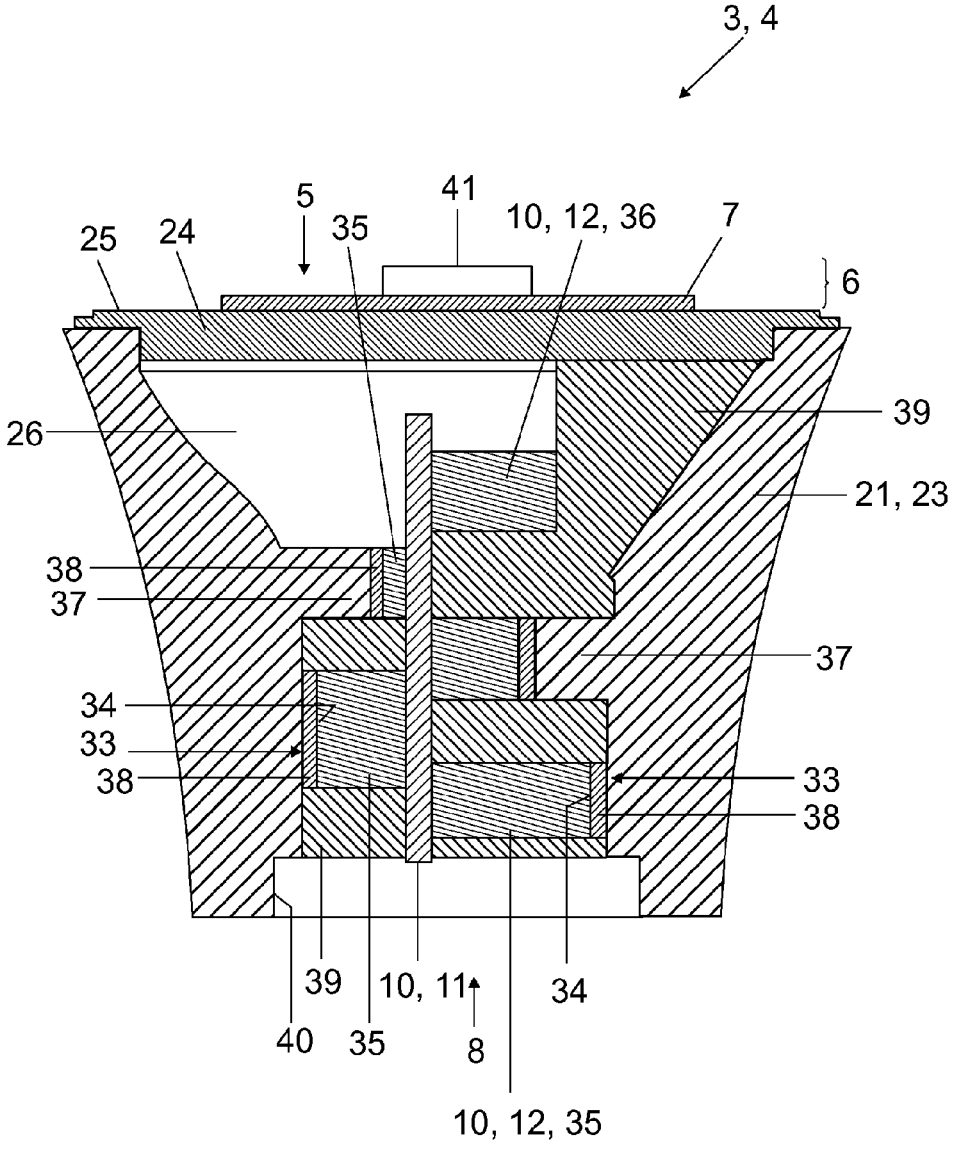
FIG. 4 shows a cross-sectional view in sectional representation of the cooling member from FIG. 2 in greater detail.

In the cooling member parts 3,4 according to FIGS. 2 and 27,28 according to FIG. 4, one or more recesses (not shown) can be present in the side wall 23 in order to accommodate electronic component parts of the control electronics unit, in particular large-volume component parts, specifically a transformer.

FIG. 4 shows a cross-sectional view in sectional representation of the cooling member 3,4 from FIG. 2 in greater detail. A control electronics unit 10 equipped on both sides is fully incorporated in the mounting cavity 8. The side wall 23 has plane surface area regions 33 which match an adjacent plane surface area 34 of an electronic component part 12 of the control electronics unit 10. More precisely, one surface area region 33 of the wall 21 is situated plane-parallel with the associated surface area 34 of the closely adjacent electronic component part 12. By this means it is possible to achieve a very small, constant distance d between the control electronics unit 10 or an electronic component part 12 and the cooling member part 3,4. However, not all electronic component parts need to be positioned close to the cooling member 2 or on the cooling member part 3,4, while it may be that only critical components 35 are disposed thus, for example those particularly susceptible to overheating. For other (in particular non-critical) component parts 36, such as for example resistors which are not sensitive to temperature, greater distances may however be provided. In order to implement the small distance d for all critical component parts 35, the cavity 8 now no longer has smooth side walls 23 but also has inward pointing projections 37 which project with a respective plane surface area 33 toward an associated plane surface area 34 of an electronic component part 35 and thereby achieve a small distance d even in the case of component parts 35 having different heights. By preference, the distance is less than 1 mm, in particular less than 0.5 mm.

To provide for better heat transfer from the control electronics unit 10 to the cooling member 2 the space between is filled as completely as possible with at least one thermally conductive material 38,39. Alternatively, for example only the critical components 35 may be thermally coupled to the cooling member 2 by way of a thermally conductive material 38. Here, the respective distance d between the critical component parts 35 and the wall 21,23 is thermally bridged by inserting a thermally conductive pad 38 having a thermal conductivity of at least 5 W/(m·K), for example by using Fujipoly SARCON Type GR-m or XR-e thermally conductive pads at 6 or 11 W/(m·K) respectively or Bergquist Gap Pad 5000535 at 5 W/(m·K). On the other hand, for the remaining space it is possible to use a filler material 39, in particular flowable, which is simple to fill, having a lower coefficient of thermal conductivity, for example Bergquist Gap Filler 350053 having a flowable, in particular paste-/gel-like, consistency at 3.6 W/(m·K).

When the equipping layout of the control electronics unit 10 is known, the cooling member 2 can thus be matched in a simple manner to the location and geometry of the electronic component parts 35 having a particular cooling requirement. It is thereby possible to attain optimum cooling of the control electronics unit 10 whilst simultaneously achieving a compact construction and simple manufacturability. Alternatively or additionally, it is possible when designing the circuit board of the control electronics unit 10 to coordinate the arrangement of the critical electronic components 35 as far as possible with the realizable cavity 8. With regard to the design of cavity 8 and control electronics unit 10, there is no need to consider whether the control electronics unit 10 can be pushed into the cavity 8. For insertion of the insulating part 15 into the cavity 8, the latter has a widening 40 at its opening.

On the fastening surface 25 at the outer side of the top wall 24 is placed the LED module 6 which has a high-power LED 41 that is fastened on the circuit board 7.

Figure 5:
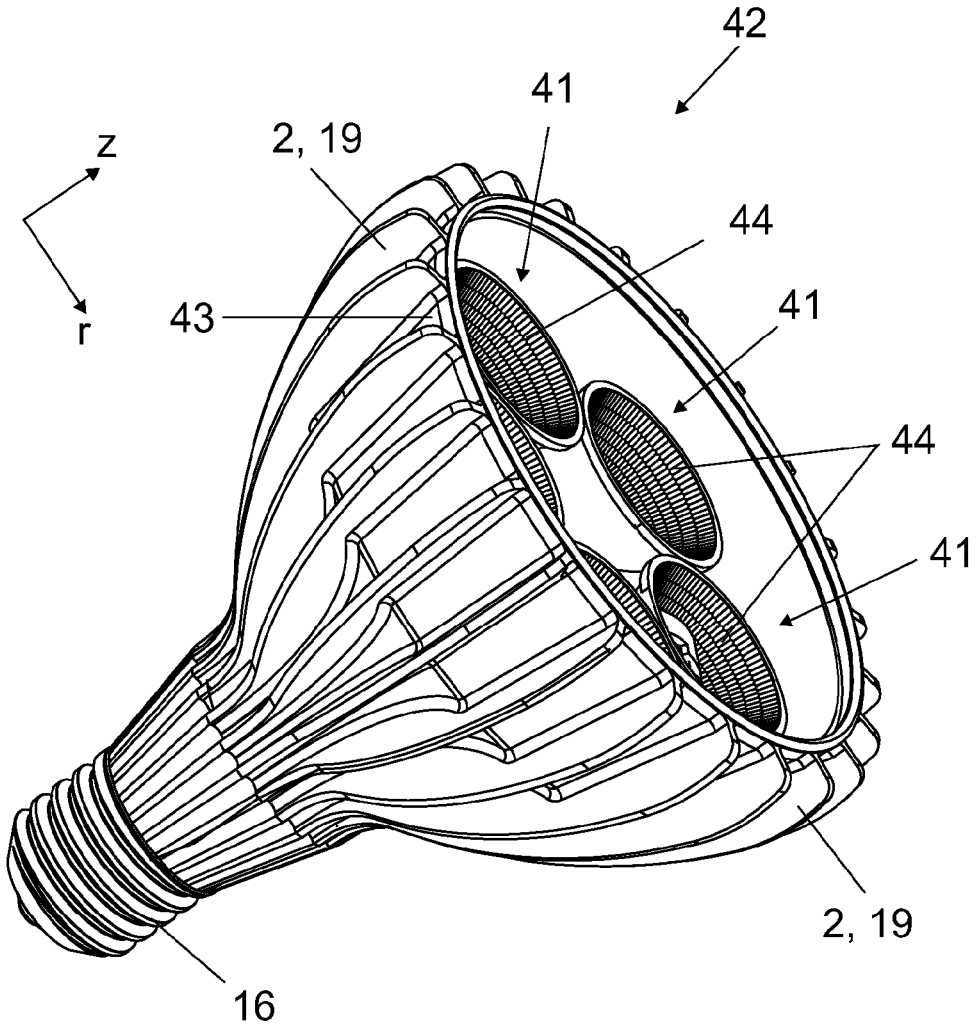
FIG. 5 shows a side view of a further LED lamp according to a further embodiment.

FIG. 5 shows a side view of a further LED lamp 42 according to a second embodiment, wherein the side wall 43 with the cooling fins 19 is now drawn forward over the LED fastening surface. The LED lamp 42 has 5 LEDs 41, each of which has a forward pointing reflector 44 in order to increase the light intensity.

The present invention is naturally not restricted to the exemplary embodiment shown.

The invention can therefore also be applied to LED lamps having one or more low-power LEDs, or also to lamps having other types of light sources, such as laser diodes or compact fluorescent tubes.

The LED lamp can have one or more light emitting diodes. These can be present as individual diode(s) and/or as LED module(s), whereby one or more LED modules are equipped with multiple LED chips on a common submount. The light emitting diodes can emit one color or different colors. The light emitting diodes can in particular in each case emit white light or emit different colors and produce a white mixed light. Light emitting diodes emitting different colors can in particular be present as an RGB, RGBA, RGBW, RGBAW etc. combination, whereby a luminous intensity of a color can also be set through provision of a certain number of light emitting diodes of this color. The individual light emitting diodes and/or the modules can be fitted with suitable optical systems for beam guidance, for example Fresnel lenses, collimators, and so forth. Instead of or in addition to inorganic light emitting diodes, for example based on InGaN or AlInGaP, organic LEDs (OLEDs) can generally also be employed. Diode lasers can also be used, for example.

While there has been particularly shown and described specific embodiments, it should be understood by those skilled in the art that various changes in form and detail may be made therein without departing from the spirit and scope as defined by the appended claims.

The invention claimed is:

1. A cooling member for at least one semiconductor light emitting element, comprising:

a mounting cavity for accommodating at least part of a control electronics unit, wherein the cooling member is composed of a plurality of cooling member parts, and wherein each of the cooling member parts includes part of a wall of the mounting cavity; and a thermal interface material incorporated between at least one electronic component of the control electronics unit and the cooling member.

2. The cooling member as claimed in claim 1, wherein each of the cooling member parts exhibits essentially the same basic shape.

3. The cooling member as claimed in claim 1, which is composed of two cooling member parts.

4. The cooling member as claimed in claim 1, wherein a connection plane of two cooling member parts is situated parallel to or on an axis of symmetry of the cooling member.

5. The cooling member as claimed in claim 1, wherein the cavity comprises at least one fixing means for fixing the control electronics unit.

6. The cooling member as claimed in claim 1, wherein the wall of the mounting cavity comprises at least one recess for accommodating an electronic component part of the control electronics unit.

7. The cooling member as claimed in claim 1, wherein two cooling member parts to be joined together comprise matching connection elements and connection counterelements.

8. The cooling member as claimed in claim 1, comprising at least one cable feedthrough between the mounting cavity and a fastening surface separated therefrom by an upper top wall for fitting the at least one semiconductor lighting element, whereby the cable feedthrough is shared among the cooling member parts.

9. The cooling member as claimed in claim 1, wherein a fastening surface for fitting the at least one semiconductor lighting element is shared among the cooling member parts.

10. A lamp comprising:

a cooling member for at least one semiconductor light emitting element, comprising:

a mounting cavity for accommodating at least part of a control electronics unit, wherein the cooling member is composed of a plurality of cooling member parts, and wherein each of the cooling member parts includes part of a wall of the mounting cavity, wherein at least part of at least one control electronics unit is accommodated in the mounting cavity; and a thermal interface material incorporated between at least one electronic component of the control electronics unit and the cooling member.

11. The lamp as claimed in claim 10, wherein the shape of the mounting cavity and the shape of the control electronics unit are matched to one another such that at least one wall region of the mounting cavity is formed plane-parallel with respect to an opposite surface area of the electronic component.

12. The lamp as claimed in claim 11, wherein at least one wall region of the mounting cavity, which is formed plane-parallel with respect to an opposite surface area of the electronic component, constitutes a part of a projection or of a recess of the mounting cavity.

13. The lamp as claimed in claim 10, wherein an insulating part attaches to an opening of the mounting cavity and the insulating part is at least partially covered by a lamp cap, whereby the cooling member parts are connected by means of at least one of the insulating part and the connector cap.

14. The cooling member as claimed in claim 1, wherein the at least one semiconductor light emitting element is an LED.

15. The cooling member as claimed in claim 2, wherein the same basic shape is an identical shape.

16. The cooling member as claimed in claim 4, wherein the axis of symmetry is a longitudinal axis (L).

17. The cooling member as claimed in claim 6, wherein the electronic component part of the control electronics unit is a transformer.

18. The cooling member as claimed in claim 1, wherein the thermal interface material is in the form of a thermally conductive pad.

19. The cooling member as claimed in claim 13, wherein the insulating part is made of plastic.

* * * * *